US007588102B2

(12) United States Patent
Hall et al.

(10) Patent No.: US 7,588,102 B2
(45) Date of Patent: Sep. 15, 2009

(54) HIGH IMPACT RESISTANT TOOL

(76) Inventors: David R. Hall, 2185 S. Larsen Pkwy., Provo, UT (US) 84606; Ronald B. Crockett, 2185 S. Larsen Pkwy., Provo, UT (US) 84606

( * ) Notice: Subject to any disclaimer, the term of this patent is extended or adjusted under 35 U.S.C. 154(b) by 266 days.

(21) Appl. No.: 11/691,978

(22) Filed: Mar. 27, 2007

(65) Prior Publication Data

US 2008/0099251 A1 May 1, 2008

Related U.S. Application Data

(63) Continuation-in-part of application No. 11/673,634, filed on Feb. 12, 2007, which is a continuation-in-part of application No. 11/668,254, filed on Jan. 29, 2007, now Pat. No. 7,353,893, which is a continuation-in-part of application No. 11/553,338, filed on Oct. 26, 2006.

(51) Int. Cl.
*E21B 10/46* (2006.01)

(52) U.S. Cl. ..... 175/434; 175/425; 175/435; 299/110; 51/309; 76/108.2

(58) Field of Classification Search ..... 175/425, 175/434, 435; 299/110, 111, 113; 51/309; 76/108.2
See application file for complete search history.

(56) References Cited

U.S. PATENT DOCUMENTS

| | | | |
|---|---|---|---|
| 2,004,315 | A | 6/1935 | Fean |
| 2,124,438 | A | 7/1938 | Struk |
| 3,254,392 | A | 6/1966 | Novkov |
| 3,746,396 | A | 7/1973 | Radd |
| 3,807,804 | A | 4/1974 | Kniff |
| 3,932,952 | A | 1/1976 | Helton |
| 3,945,681 | A | 3/1976 | White |
| 4,005,914 | A | 2/1977 | Newman |
| 4,006,936 | A | 2/1977 | Crabiel |
| 4,098,362 | A | 7/1978 | Bonnice |
| 4,109,737 | A | 8/1978 | Bovenkerk |
| 4,156,329 | A | 5/1979 | Daniels |
| 4,199,035 | A | 4/1980 | Thompson |
| 4,201,421 | A | 5/1980 | Den Besten |
| 4,268,089 | A | 5/1981 | Spence |
| 4,277,106 | A | 7/1981 | Sahley |
| 4,439,250 | A | 3/1984 | Acharya |
| 4,465,221 | A | 8/1984 | Acharya |

(Continued)

FOREIGN PATENT DOCUMENTS

| | | |
|---|---|---|
| DE | 3500261 | 7/1986 |

(Continued)

*Primary Examiner*—David J Bagnell
*Assistant Examiner*—Brad Harcourt
(74) *Attorney, Agent, or Firm*—Tyson J. Wilde

(57) ABSTRACT

A tool has a sintered body of diamond or diamond-like particles in a metal matrix bonded to a cemented metal carbide substrate at a non-planar interface. A working surface has at least one region fir enough away from the non-planar interface that during high pressure, high temperature processing a restricted amount of metal from the substrate reaches the region, the amount comprising 5 to 0.1 percent of the region by volume, resulting in the region having a high density of superhard particles.

20 Claims, 9 Drawing Sheets

U.S. PATENT DOCUMENTS 4,484,644 A 11/1984 Cook
4,484,783 A 11/1984 Emmerich
4,489,986 A 12/1984 Dziak
4,636,253 A * 1/1987 Nakai et al. ..... 75/239
4,678,237 A 7/1987 Collin
4,682,987 A 7/1987 Brady
4,684,176 A 8/1987 Den Besten et al.
4,688,856 A 8/1987 Elfgen
4,725,098 A 2/1988 Beach
4,729,603 A 3/1988 Elfgen
4,765,686 A 8/1988 Adams
4,765,687 A 8/1988 Parrott
4,776,862 A 10/1988 Wiand
4,880,154 A 11/1989 Tank
4,932,723 A 6/1990 Mills
4,940,288 A 7/1990 Stiffler
4,944,559 A 7/1990 Sionnet
4,951,762 A 8/1990 Lundell
5,007,685 A 4/1991 Beach
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,303,984 A 4/1994 Ojanen
5,332,348 A 7/1994 Lemelson
5,417,475 A 5/1995 Graham
5,447,208 A 9/1995 Lund
5,535,839 A 7/1996 Brady
5,542,993 A 8/1996 Rabinkin
5,653,300 A 8/1997 Lund
5,720,528 A 2/1998 Ritchey
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,884,979 A 3/1999 Latham
5,934,542 A 8/1999 Nakamura
5,935,718 A 8/1999 Demo
5,944,129 A 8/1999 Jenson
5,967,250 A 10/1999 Lund
5,992,405 A 11/1999 Sollami
6,003,623 A * 12/1999 Miess ..... 175/430
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,220,375 B1 * 4/2001 Butcher et al. ..... 175/428
6,270,165 B1 8/2001 Peay
6,341,823 B1 1/2002 Sollami
6,354,771 B1 3/2002 Bauschulte
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,481,803 B2 11/2002 Ritchey
6,499,547 B2 12/2002 Scott
6,517,902 B2 2/2003 Drake
6,585,326 B2 7/2003 Sollami
6,685,273 B1 2/2004 Sollami
6,702,393 B2 3/2004 Mercier
6,709,065 B2 3/2004 Peay
6,719,074 B2 4/2004 Tsuda
6,733,087 B2 5/2004 Hall
6,739,327 B2 5/2004 Sollami
6,758,530 B2 7/2004 Sollami
6,786,557 B2 9/2004 Montgomery
6,824,225 B2 11/2004 Stiffler
6,861,137 B2 3/2005 Griffin
6,889,890 B2 5/2005 Yamazaki
6,966,611 B1 11/2005 Sollami
6,994,404 B1 2/2006 Sollami
7,204,560 B2 4/2007 Mercier
2002/0074851 A1 6/2002 Montgomery
2002/0153175 A1 10/2002 Ojanen
2002/0175555 A1 11/2002 Mercier
2003/0140350 A1 7/2003 Noro
2003/0209366 A1 11/2003 McAlvain
2003/0234280 A1 12/2003 Cadden
2004/0026983 A1 2/2004 McAlvain
2004/0065484 A1 4/2004 McAlvain
2005/0159840 A1 7/2005 Lin
2006/0237236 A1 10/2006 Sreshta
2007/0193782 A1 * 8/2007 Fang et al. ..... 175/374

FOREIGN PATENT DOCUMENTS

DE 3818213 11/1989
DE 4039217 6/1992
DE 19821147 11/1999
DE 10163717 5/2003
EP 0295151 6/1988
EP 0412287 7/1990
GB 2004315 3/1979
GB 2037223 11/1979
JP 3123193 1/2001

* cited by examiner

HIGH IMPACT RESISTANT TOOL

This application is a continuation in-part of U.S. patent application Ser. No. 11/673,634 filed on Feb. 12, 2007 entitled Thick Pointed Superhard Material. U.S. patent application Ser. No. 11/673,634 is a continuation in-part of U.S. patent application Ser. No. 11/668,254 which was filed on Jan. 29, 2007 now U.S. Pat. No 7,353,893 and entitled A Tool with a Large Volume of a Superhard Material. U.S. patent application Ser. No. 11/668,254 is a continuation in-part of U.S. patent application Ser. No. 11/553,338 which was filed on Oct. 26, 2006 and was entitled Superhard Insert with an Interface. Both of these applications are herein incorporated by reference for all that they contain and are currently pending.

BACKGROUND OF THE INVENTION

The invention relates to a high impact resistant tool that may be used in machinery such as crushers, picks, grinding mills, roller cone bits, rotary fixed cutter bits, earth boring bits, percussion bits or impact bits, and drag bits. More particularly, the invention relates to inserts comprised of a carbide substrate with a non-planar interface and an abrasion resistant layer of super hard material affixed thereto using a high pressure high temperature press apparatus. Such inserts typically comprise a super hard material layer or layers formed under high temperature and pressure conditions, usually in a press apparatus designed to create such conditions, cemented to a carbide substrate containing a metal binder or catalyst such as cobalt. The substrate is often softer than the super hard material to which it is bound. Some examples of super hard materials that high pressure high temperature (HPHT) presses may produce and sinter include cemented ceramics, diamond, polycrystalline diamond, and cubic boron nitride. A cutting element or insert is normally fabricated by placing a cemented carbide substrate into a container or cartridge with a layer of diamond crystals or grains loaded into the cartridge adjacent one face of the substrate. A number of such cartridges are typically loaded into a reaction cell and placed in the high pressure high temperature press apparatus. The substrates and adjacent diamond crystal layers are then compressed under HPHT conditions which promotes a sintering of the diamond grains to form the polycrystalline diamond structure. As a result, the diamond grains become mutually bonded to form a diamond layer over the substrate interface. The diamond layer is also bonded to the substrate interface.

Such inserts are often subjected to intense forces, torques, vibration, high temperatures and temperature differentials during operation. As a result, stresses within the structure may begin to form. Drill bits for example may exhibit stresses aggravated by drilling anomalies during well boring operations such as bit whirl or bounce often resulting in spalling, delamination or fracture of the super hard abrasive layer or the substrate thereby reducing or eliminating the cutting elements efficacy and decreasing overall drill bit wear life. The superhard material layer of an insert sometimes delaminates from the carbide substrate after the sintering process as well as during percussive and abrasive use. Damage typically found in percussive and drag bits may be a result of shear failures, although non-shear modes of failure are not uncommon The interface between the superhard material layer and substrate is particularly susceptible to non-shear failure modes due to inherent residual stresses.

U.S. Pat. No. 5,544,713 by Dennis, which is herein incorporated by reference for all that it contains, discloses a cutting element which has a metal carbide stud having a conic tip formed with a reduced diameter hemispherical outer tip end portion of said metal carbide stud. The tip is shaped as a cone and is rounded at the tip portion. This rounded portion has a diameter which is 35-60% of the diameter of the insert.

U.S. Pat. No. 6,408,959 by Bertagnolli et al., which is herein incorporated by reference for all that it contains, discloses a cutting element, insert or compact which is provided for use with drills used in the drilling and boring of subterranean formations.

U.S. Pat. No. 6,484,826 by Anderson et al., which is herein incorporated by reference for all that it contains, discloses enhanced inserts formed having a cylindrical grip and a protrusion extending from the grip.

U.S. Pat. No. 5,848,657 by Flood et al, which is herein incorporated by reference for all that it contains, discloses domed polycrystalline diamond cutting element wherein a hemispherical diamond layer is bonded to a tungsten carbide substrate, commonly referred to as a tungsten carbide stud. Broadly, the inventive cutting element includes a metal carbide stud having a proximal end adapted to be placed into a drill bit and a distal end portion. A layer of cutting polycrystalline abrasive material disposed over said distal end portion such that an annulus of metal carbide adjacent and above said drill bit is not covered by said abrasive material layer.

U.S. Pat. No. 4,109,737 by Bovenkerk which is herein incorporated by reference for all that it contains, discloses a rotary bit for rock drilling comprising a plurality of cutting elements mounted by interence-fit in recesses in the crown of the drill bit. Each cutting element comprises an elongated pin with a thin layer of polycrystalline diamond bonded to the free end of the pin.

US Patent Application Serial No. 2001/0004946 by Jensen, although now abandoned, is herein incorporated by reference for all that it discloses. Jensen teaches that a cutting element or insert with improved wear characteristics while maximizing the manufacturability and cost effectiveness of the insert. This insert employs a superabrasive diamond layer of increased depth and by making use of a diamond layer surface that is generally convex.

BRIEF SUMMARY OF THE INVENTION

A tool has a sintered body of diamond or diamond-like particles in a metal matrix bonded to a cemented metal carbide substrate at a non-planar interface. A working surface has at least one region far enough away from the non-planar interface that during high pressure, high temperature processing a restricted amount of metal from the substrate reaches the region, the amount comprising 5 to 0.1 percent of the region by volume, resulting in the region having a high density of superhard particles. The time of processing may be from 4 to 10 minutes and the temperature may be from 1200 C to 1700 C.

The region may be at least 0.100 inches away from the interface. The region may be substantially non-electrically conductive. The region may comprise the characteristic of being able to withstand an impact of at least 80 joules. The region may comprise a point. The point may comprise a radius of 0.030 to 0.400 inches. The sintered body tapered to the point and the point may form an included angle of 30 to 50 degrees.

The tool may be a shear cutter. The tool may be adapted to be used in asphalt picks, mining picks, drill bits, heat sinks, roller cone bits, shear bits, percussion bits, mills, chisels, hammer mills, cone crushers, mulchers, jaw crushers, vertical shaft mills, bearings, indenters, valves, dies, wear parts, or combinations thereof.

The superhard material may comprise a geometry selected from the group consisting of conical, rounded, flat, cylindrical, semi-spherical, and combinations thereof. The non-planar interface may comprise a flatted portion adapted to be substantially normal to a pre-determined angle of impact. The sintered body may comprise 75 to 150 percent volume of the substrate. The sintered body may comprise a metal concentration of less than 4 percent by volume. The sintered body may be monolithic. The carbide substrate may comprise a volume from 0.010 to 0.500 cubic inches. The cemented metal carbide substrate may comprise a metal concentration of 2 to 10 percent metal by volume.

At least 99 percent of interstitial voids between particles may comprise a catalyzing material. The diamond may comprise a particle size with an average size of 0.5 to 60 microns. The metal may be selected from the group consisting of cobalt, nickel, iron, titanium, tantalum, niobium, alloys thereof and combinations thereof.

A method for manufacturing a high impact resistant tool comprises the steps of providing a body of diamond or diamond-like particles and a cemented metal carbide substrate with a non-planar interface, the body comprising a working surface with a region at least 0.100 to 0.500 inches away from the interface; providing a cemented metal carbide substrate with a cobalt concentration of 2 to 10 percent by volume; and sintering the body to the substrate in a high pressure, high temperature process just long enough for the cobalt to reach the region such that the cobalt concentration becomes 53 to 0.1 percent of the volume of the region.

DETAILED DESCRIPTION OF THE INVENTION AND THE PREFERRED EMBODIMENT

Figure 1:
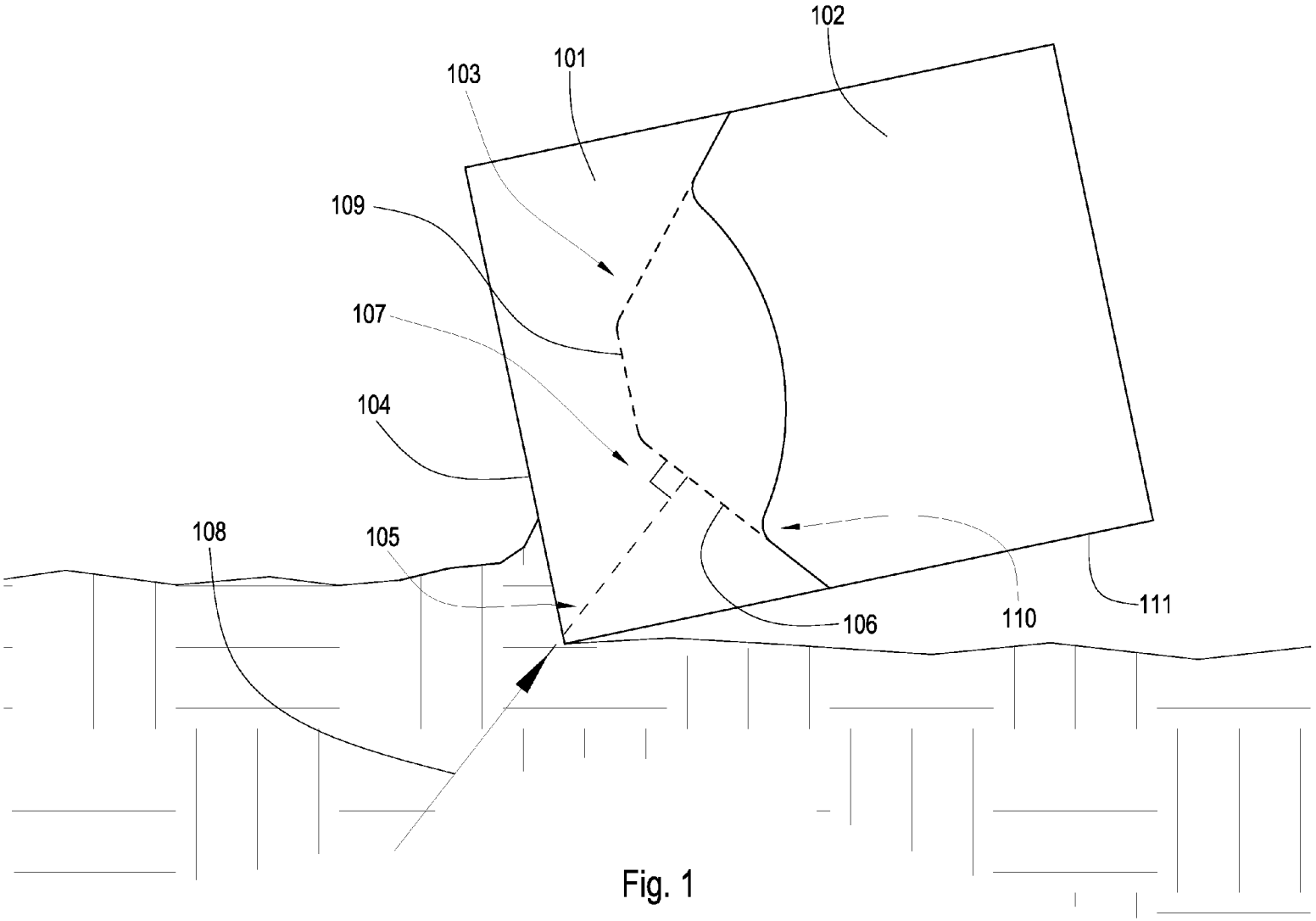
FIG. 1 is a cross-sectional diagram of an embodiment of a high impact resistant tool.

FIG. 1 discloses an embodiment of a high impact resistant tool 100 which may be used in machines in mining, downhole drilling, asphalt milling, or trenching industries. The high impact resistant tool comprises a sintered body 101 of diamond or diamond-like particles in a metal matrix bonded to a cemented metal carbide substrate 102 at a non-planar interface 103, a hidden portion of which is shown by the dashed line. The body 101 comprises a working surface 104 used to abrade or degrade road surfaces, downhole rock and earth formations, or other materials.

The amount of metal in the body 101 of the high impact resistant tool 100 may be vital to the working life of the tool 100, particularly in regions near the working surface 104. At least one region 105 of the working surface 104 is far enough away from the non-planar interface 103 that during high pressure, high temperature (HPHT) processing a restricted amount of metal from the substrate reaches the region 105, the amount comprising 3 to 0.1 percent of the region by volume, resulting in the region 105 comprising a high density of superhard particles. The region 105 may comprise the characteristic of being able to withstand an impact of at least 80 joules, and in some embodiments more than 120 joules. Also, due to the low metal concentration in the region 105, the region 105 may be substantially non-electrically conductive. The diamond in the sintered body 101 and may comprise an average particle size of 15 to 60 microns.

The metal may be distributed throughout the body 101 evenly, though the metal may be distributed progressively, being more highly concentrated near the interface 103 than near the working surface 104. Grain bridging may occur during the HPHT processing such that the diamond comprises more highly compressed particles near the working surface 104 and less compressed particles near the interface 103. This bridging may allow for more interstitial voids near the interface 103 than in the region 105 near the working surface 104, which may allow for more metal particles to occupy the voids near the interface 103 and fewer near the working surface 104. The concentration of metal in the region is dependent on the thickness of the sintered body. A thicker body results in a lower concentration of metal in the region near the working surface. The low levels of metal are not obtained through removing the metal, as in the process of leaching. At least 99 percent of interstitial voids between particles may comprise a catalyzing material such as metal. In some embodiments, during high pressure high temperature processing the metal from the substrate may not infiltrate all of the diamond powder, which will result in a weak bond. This weakly bonded diamond may be removed by grinding back to the sintered diamond which contains the 0.1 to 3 percent metal.

The cemented metal carbide substrate 102 may comprise a metal concentration of 2 to 10 percent metal by volume. The sintered body 101 may comprise a metal concentration of less than 4 percent by volume. The sintered body 101 may be monolithic. In some embodiments, it may also comprise 75 to 150 percent volume of the carbide substrate 102.

A common metal or catalyzing material used in sintering diamond is cobalt, though the metal may be selected from the group consisting of cobalt, nickel, iron, titanium, tantalum, niobium, alloys thereof and combinations thereof The metal in the body 101 may provide added impact strength to the high impact resistant tool 100, while a low metal concentration and high diamond density near the working surface 104 may provide better wear resistance to the tool 100. Thus, the high impact resistant tool 100 may have increased characteristics of both impact strength and wear resistance over tools of the prior art.

The high diamond/low metal density in the region 105 near the working surface 104 may be achieved by controlling the temperature and time of sintering during HPHT processing. The time of processing may be from 4 to 10 minutes and the temperature may be from 1200 C to 1700 C. A preferable combination of time and temperature during processing may be about 5 minutes at 1400-1500 C.

In the current embodiment, as the high impact resistant tool 100 degrades an earth formation, an opposing force 108 acts on the working surface 104 of the tool 100. A face 106 or flatted portion of the interface 103 may be substantially normal to a pre-determined angle 107 of impact derived from the opposing force of the formation. This may allow the force 108 to be spread across the face 106 as the force acts on the tool 100, which may reduce the stress on the body 101 and the interface 103.

Figure 2:
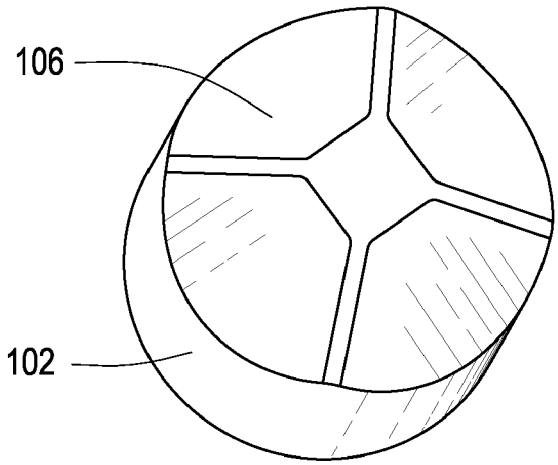
FIG. 2 is perspective diagram of an embodiment of a cemented metal carbide substrate.
Figure 3:
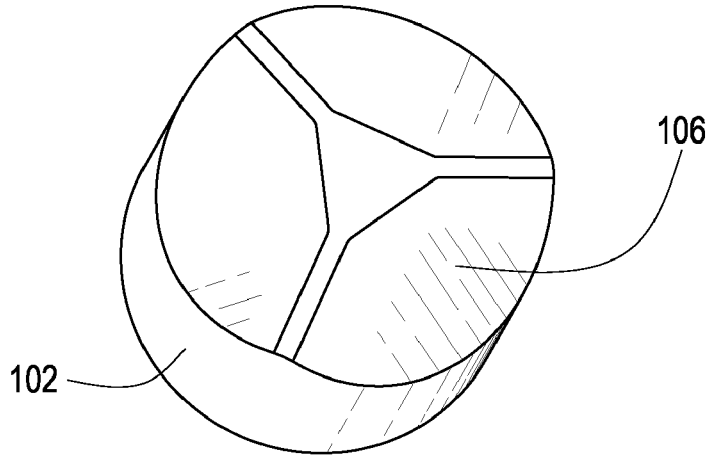
FIG. 3 is a perspective diagram of another embodiment of a cemented metal carbide substrate.
Figure 4:
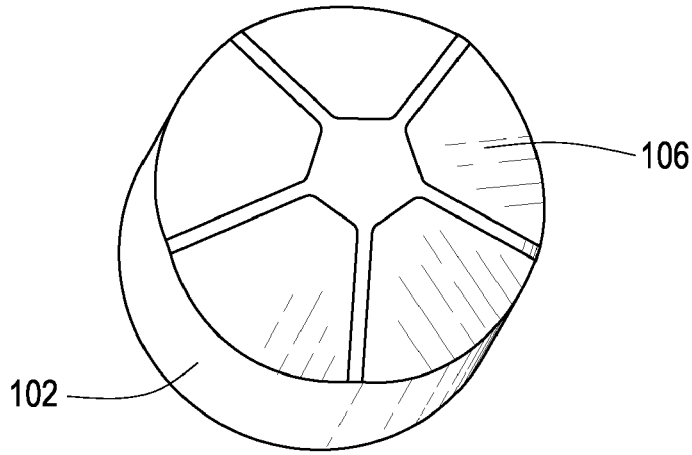
FIG. 4 is a perspective diagram of another embodiment of a cemented metal carbide substrate.

The high impact resistant tool 100 may comprise a plurality of faces 106 at the interface 103, including a flatted region 109 nearest the working face 104 of the body 101. The plurality of faces 106 may also create a plurality of ridges 110 along an outer surface 111 of the high impact resistant tool 100 at the interface where the faces meet. The carbide substrate 102 may comprise any number of faces 106, as shown in the embodiments of FIGS. 2 through 4. When the high impact resistant tool 100 is worn, it may be rotated such that another face 106 is presented to the formation. This may allow for the tool 100 to continue degrading the formation and effectively increasing its working life.

Figure 5:
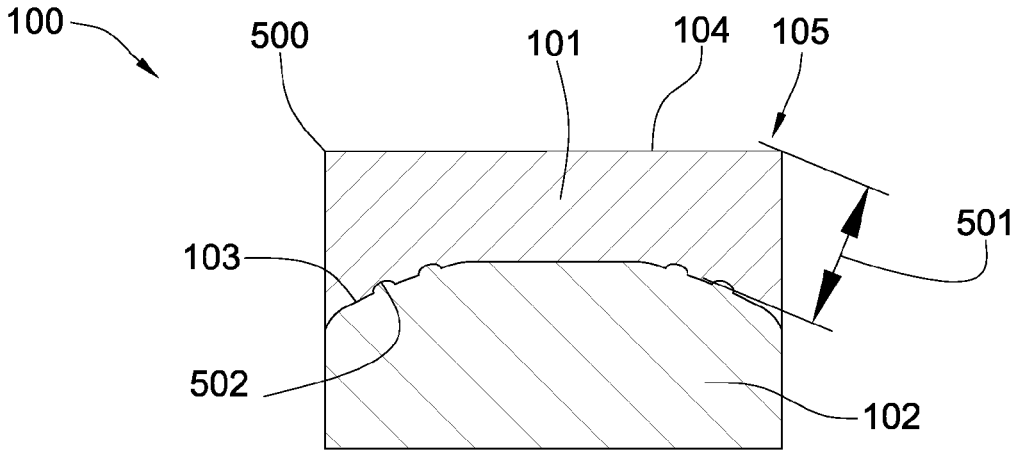
FIG. 5 is a cross-sectional diagram of another embodiment of a high impact resistant tool.

The high impact resistant tool 100 may comprise a flat working surface 104, as in the embodiment of FIG. 5. In this embodiment, the region 105 is located near an edge 500 on the working face due to the HPHT process, which may be useful in applications involving shearing where the formation exerts a force concentrated near the edge 500, such as a shear cutter. The region 105 may be located at least 0.100 to 0.500 inches away from the interface 103, depending on the distance 501 from the interface 103 to the edge 500. The interface 103 may comprise a plurality of bumps 502, ridges, dimples, or other protrusions or recesses, which may improve the bond between the substrate 102 and the sintered body 101.

Figure 6:
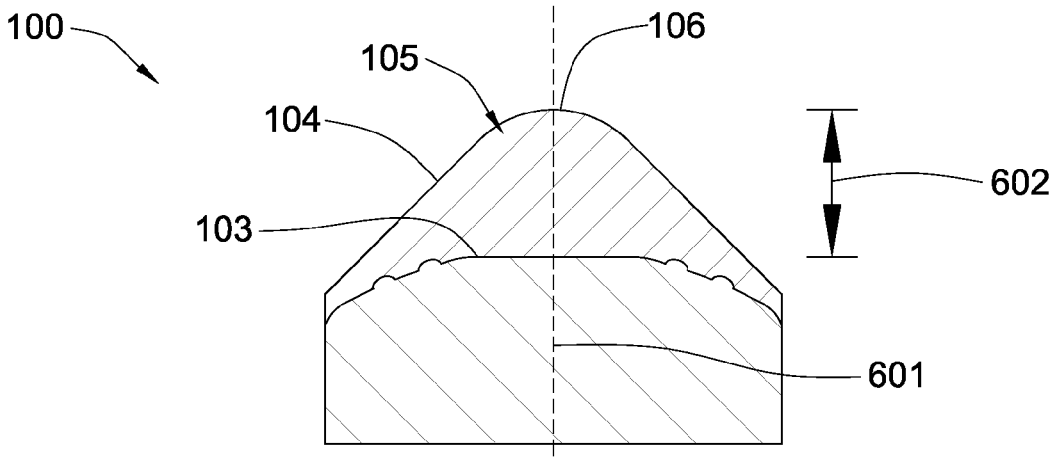
FIG. 6 is a cross-sectional diagram of another embodiment of a high impact resistant tool.
Figure 7:
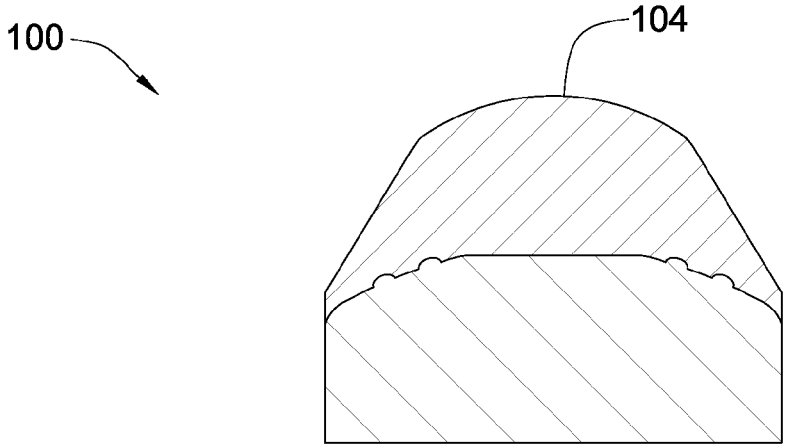
FIG. 7 is a cross-sectional diagram of another embodiment of a high impact resistant tool.
Figure 8:
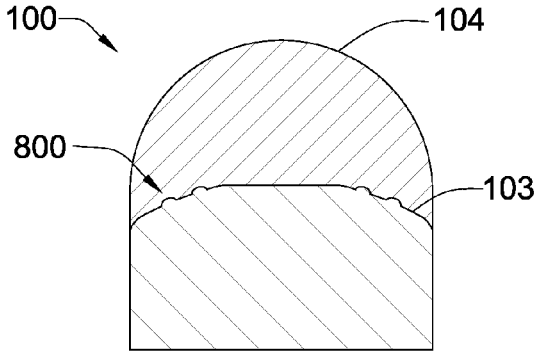
FIG. 8 is a cross-sectional diagram of another embodiment of a high impact resistant tool.
Figure 9:
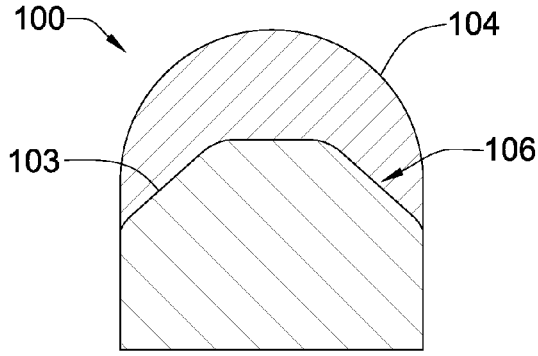
FIG. 9 is a cross-sectional diagram of another embodiment of a high impact resistant tool.
Figure 10:
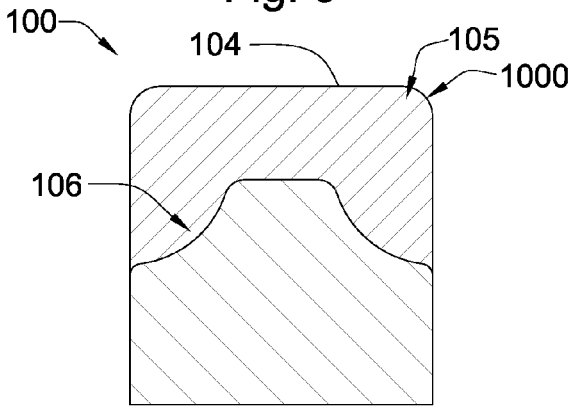
FIG. 10 is a cross-sectional diagram of another embodiment of a high impact resistant tool.
Figure 11:
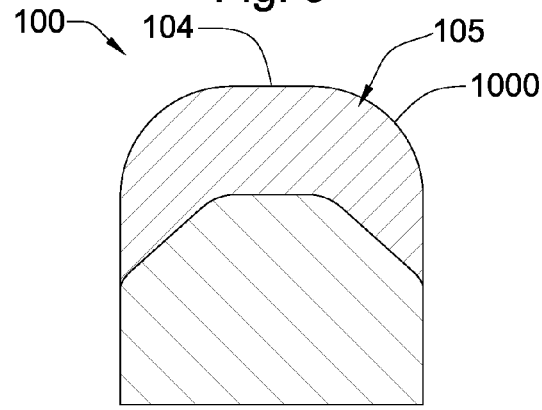
FIG. 11 is a cross-sectional diagram of another embodiment of a high impact resistant tool.
Figure 12:
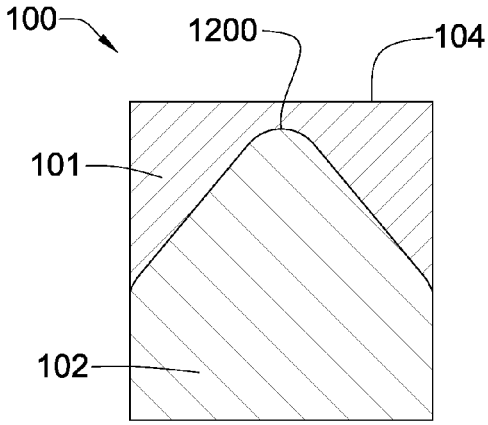
FIG. 12 is a cross-sectional diagram of another embodiment of a high impact resistant tool.
Figure 13:
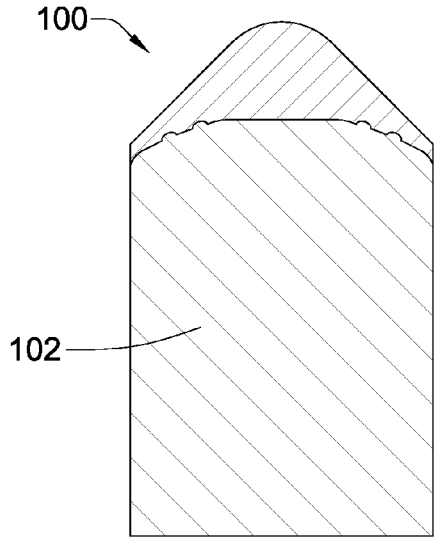
FIG. 13 is a cross-sectional diagram of another embodiment of a high impact resistant tool.
Figure 14:
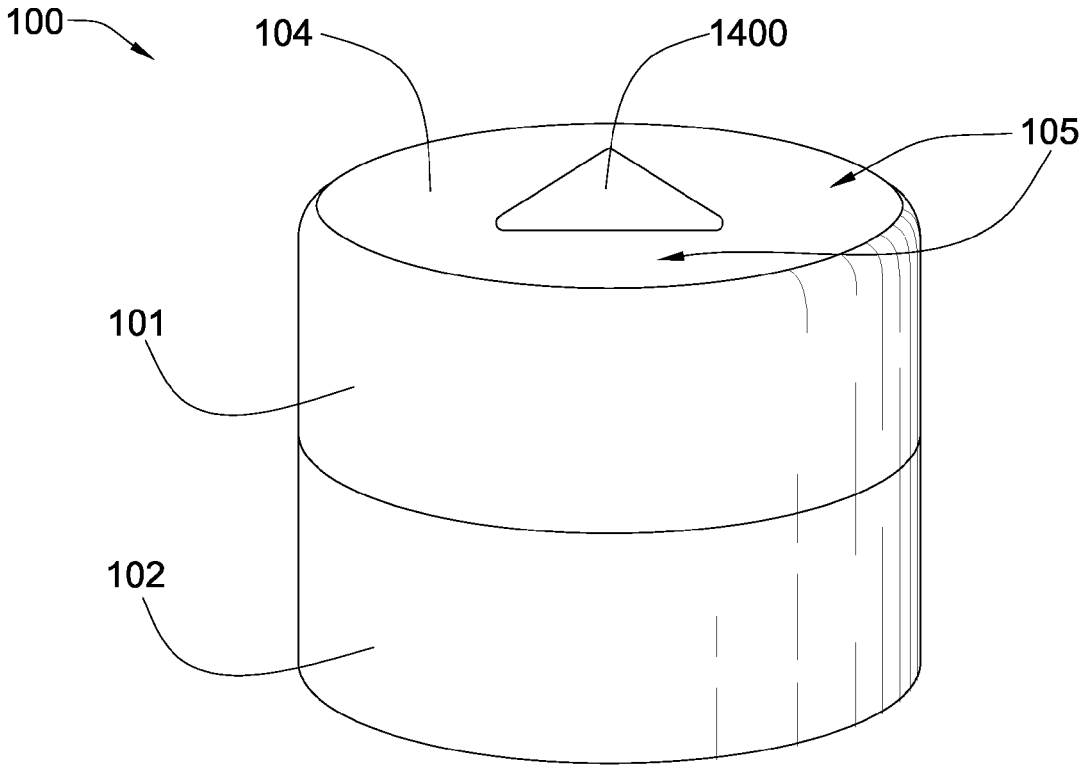
FIG. 14 is a perspective diagram of another embodiment of a high impact resistant tool.
Figure 15:
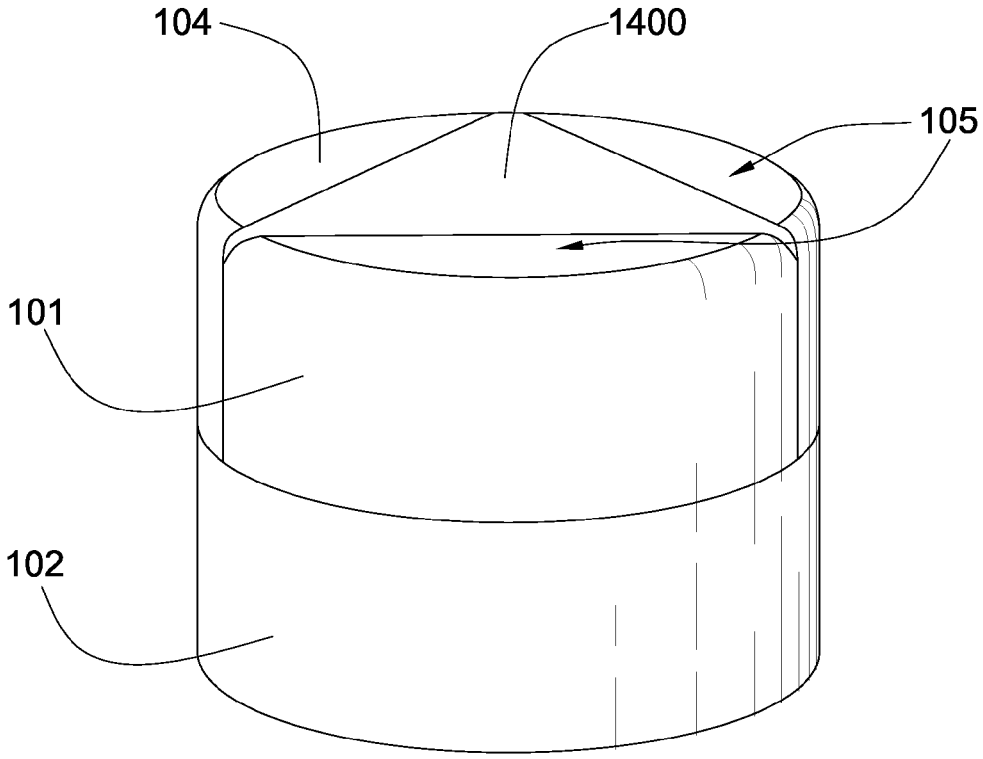
FIG. 15 is a perspective diagram of another embodiment of a high impact resistant tool.
Figure 16:
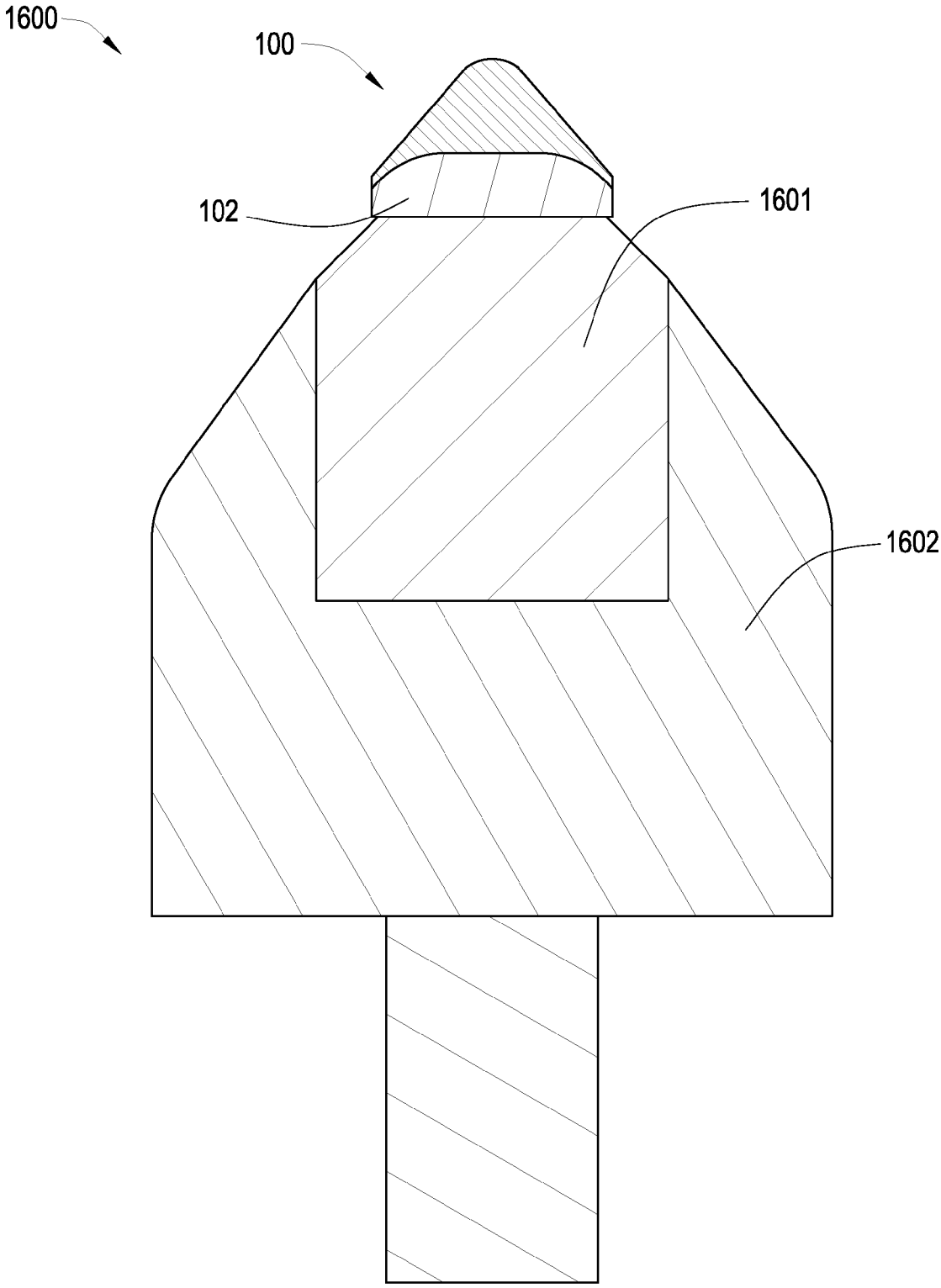
FIG. 16 is a cross-sectional diagram of an embodiment of high impact resistant tool.
Figure 17:
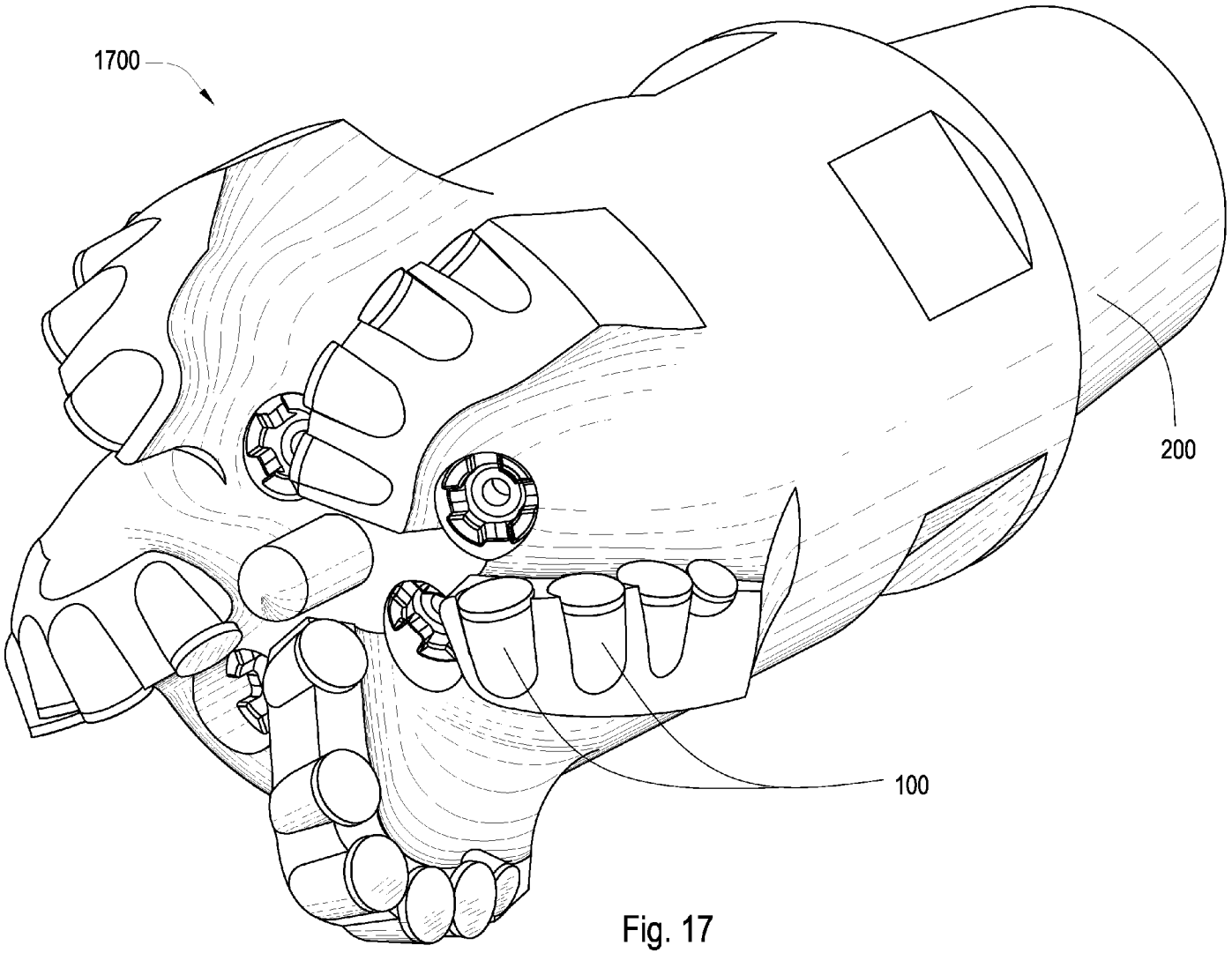
FIG. 17 is a perspective diagram of an embodiment of a drill bit.
Figure 18:
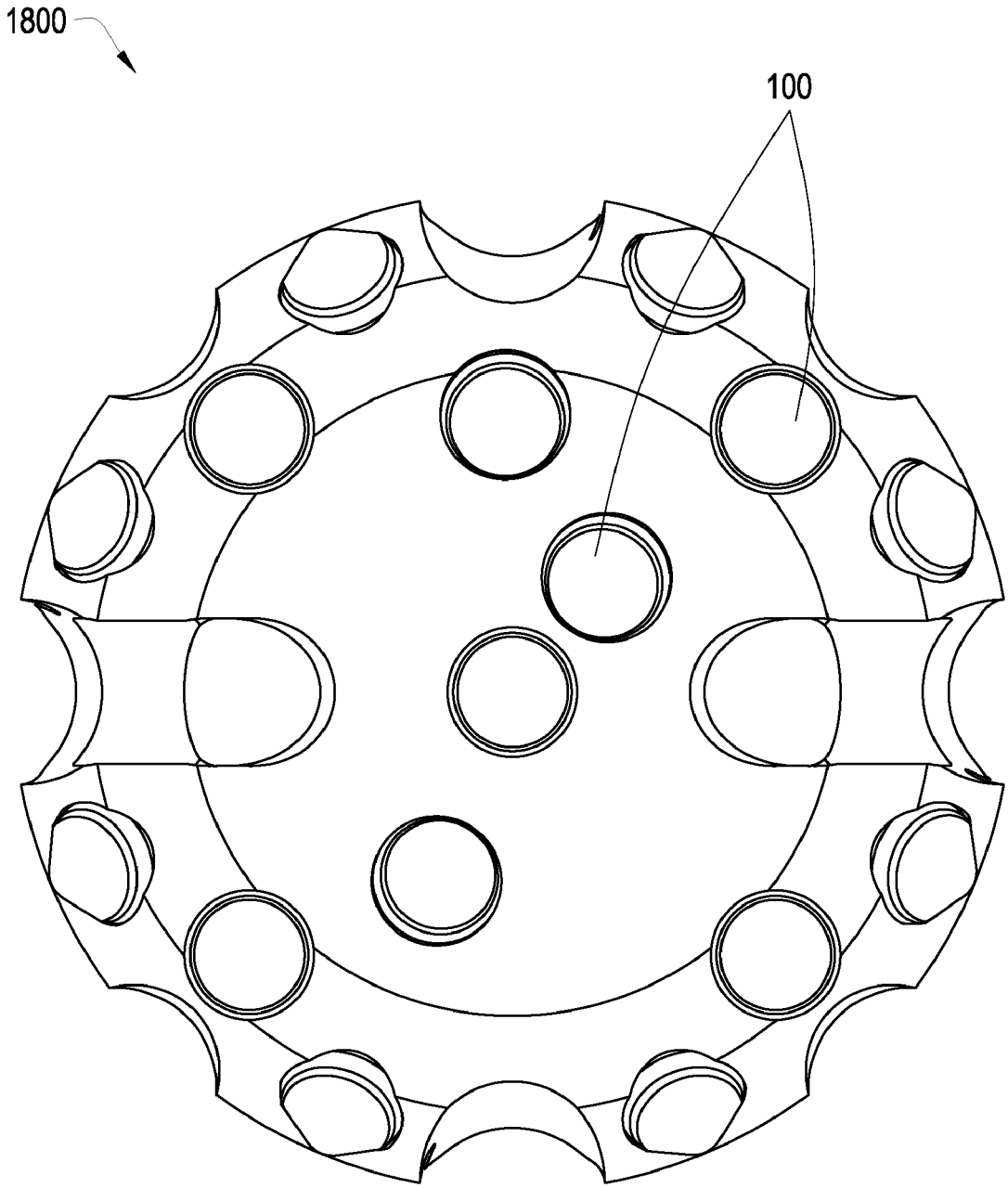
FIG. 18 is an orthogonal diagram of another embodiment of a drill bit.

The high impact resistant tool 100 may also comprise a pointed region 600 of the working surface 104, as in the embodiment of FIG. 6. In this embodiment, the region 105 is located near the pointed region 600 due to the HPHT process, which may be useful in applications where the formation exerts a force concentrated near a central axis 601 of the high impact resistant tool 100. The size and location of the region 105 may depend on the distance 602 from the interface 103 to the pointed region 600. The high impact resistant tool 100 may also comprise a blunt working surface 104, as in the embodiment of FIG. 7. The high impact resistant tool may comprise a domed working surface 104, as in the embodiments of FIGS. 8 and 9, and the interface 103 may comprise either a somewhat rounded surface 800 or faces 106. The faces 106 may be concave, as in the embodiment of FIG. 10. The high impact resistant tool 100 may also comprise a flat working surface 104 with a rounded edge 1000 or point near the region 105, comprising either a small or a large radius from 0.150 to 0.400 inches, as in the embodiments of FIGS. 10 and 11. The non-planar interface 103 may comprise a conical shape such that an apex 1200 of the interface is near the working surface 104, as in the embodiment of FIG. 12. The sintered body 101 may protect the apex 1200 of the interface from wear. The high impact resistant tool 100 may comprise a large substrate 102, as in the embodiment of FIG. 13, the volume of the substrate 102 being anywhere from 0.010 to 0.500 cubic inches. The high impact resistant tool 100 may comprise an exposed portion 1400 of the substrate 102 near the working surface 104, as shown in the embodiments of FIGS. 14 and 15. The sintered body 101 may comprise a plurality of high density superhard regions 105 wherein the exposed portion 1400 is intermediate the regions. The sintered body 101 may also be segmented. The superhard material may comprise any geometry selected from the group consisting of conical, rounded, flat, cylindrical, semi-spherical, and combinations thereof. Referring to FIG. 16, the high impact resistant tool 100 may be attached to an attack tool 1600 for use in the asphalt milling, trenching, or mining industries. The attack tool 1600 may comprise a plurality of segments 1601, 1602. The high impact resistant tool 100 may be bonded by brazing to a first segment 1601, typically made of a similar material to the carbide substrate 102. The first segment 1601 may be press fit into a second segment 1602, typically made of a material softer than the first segment 1601 such as steel. The first segment 1601 may provide wear protection for the attack tool 1600. The current invention may also be used in a drill bit in downhole drilling industries. The drill bit may be a shear bit 1700, as in the embodiment of FIG. 17, or a percussion bit 1800, as in the embodiment of FIG. 18. The tool 100 may also be adapted to be used in heat sinks, roller cone bits, mills, chisels, hammer mills, cone crushers, mulchers, jaw crushers, vertical shaft mills, bearings, indenters, valves, dies, wear parts, or combinations thereof.

Figure 19:
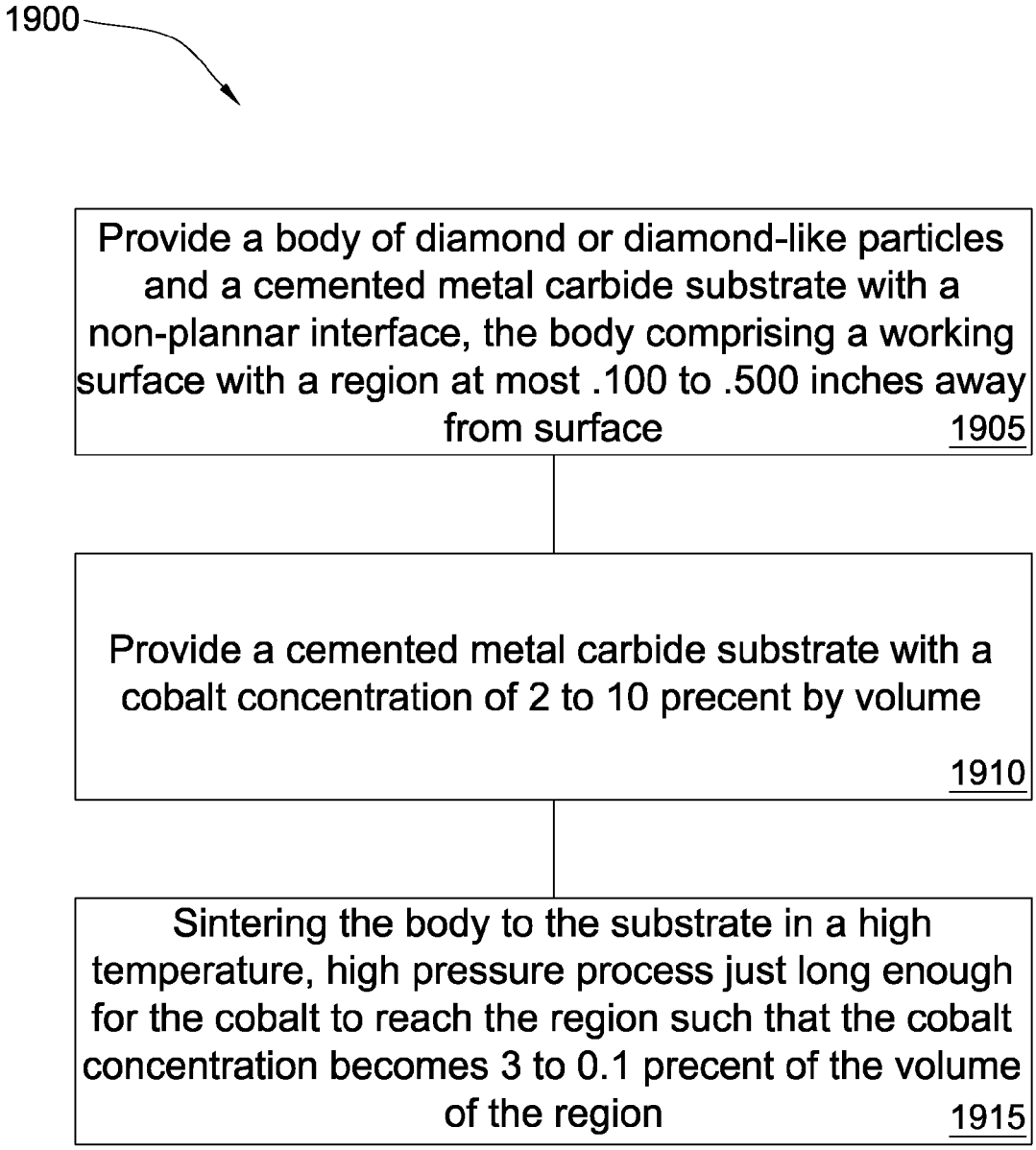
FIG. 19 is a flowchart diagram of a method for manufacturing a high impact resistant tool.

FIG. 19 discloses a method 1900 for manufacturing a high impact resistant tool, comprising the steps of providing 1905 a body of diamond or diamond-like particles and a cemented metal carbide substrate with a non-planar interface, the body comprising a working surface with a region at least 0.100 to 0.500 inches away from the interface; providing 1910 a cemented metal carbide substrate with a cobalt concentration of 4 to 10 percent by volume; and sintering 1915 the body to the substrate in a high pressure, high temperature process just long enough for the cobalt to reach the region such that the cobalt concentration becomes 3 to 0.1 percent of the volume of the region.

Whereas the present invention has been described in particular relation to the drawings attached hereto, it should be understood that other and further modifications apart from those shown or suggested herein, may be made within the scope and spirit of the present invention.

What is claimed is:

1. A high impact resistant tool, comprising:

a sintered body of diamond or diamond-like particles in a metal matrix bonded to a cemented metal carbide substrate at a non-planar interface; and a working surface of the body comprising at least one region far enough away from the non-planar interface that during high pressure, high temperature processing a restricted amount of metal from the substrate reaches the region, the amount comprising 5 to 0.1 percent of the region by volume, resulting in the region comprising a high density of superhard particles;

wherein at least 99 percent of interstitial voids between particles comprise a catalyzing material.

2. The tool of claim 1, wherein the cemented metal carbide substrate comprises a metal concentration of 2 to 10 percent metal by volume.

3. The tool of claim 1, wherein the carbide substrate comprises a volume from 0.010 to 0.500 cubic inches.

4. The tool of claim 1, wherein the region is at least 0.100 inches away from the interface.

5. The tool of claim 1, wherein the region is substantially non-electrically conductive.

6. The tool of claim 1, wherein the region comprises the characteristic of being able to withstand an impact of at least 80 joules.

7. The tool of claim 1, wherein the region comprises a point.

8. The tool of claim 7, wherein the point comprises a radius of 0.030 to 0.400 inches.

9. The tool of claim 7, wherein the sintered body tapered to the point and the point forms an included angle of 30 to 50 degrees.

10. The tool of claim 1, wherein the tool is a shear cutter.

11. The tool of claim 1, wherein the tool is adapted to be used in asphalt picks, mining picks, drill bits, heat sinks, roller cone bits, shear bits, percussion bits, mills, chisels, hammer mills, cone crushers, mulchers, jaw crushers, vertical shaft mills, bearings, indenters, valves, dies, wear parts, or combinations thereof.

12. The tool of claim 1, wherein the superhard material comprises a geometry selected from the group consisting of conical, rounded, flat, cylindrical, semi-spherical, and combinations thereof.

13. The tool of claim 1, wherein the non-planar interface comprises a flatted portion adapted to be substantially normal to a pre- determined angle of impact.

14. The tool of claim 1, wherein the sintered body comprises 75 to 150percent volume of the substrate.

15. The tool of claim 1, wherein the sintered body comprises a metal concentration of less than 4 percent.

16. The tool of claim 1, wherein the sintered body is monolithic.

17. The tool of claim 1, wherein the diamond comprises a particle size with an average size of 0.5 to 60 microns.

18. The tool of claim 1, wherein the metal is selected from the group consisting of cobalt, nickel, iron, titanium, tantalum, niobium, alloys thereof and combinations thereof.

19. The tool of claim 1, wherein the time of processing is from 4 to 10minutes and the temperature is from 1200° C. to 1700° C.

20. A method for manufacturing a high impact resistant tool, comprising:

providing a body of diamond or diamond- like particles and a cemented metal carbide substrate with a non-planar interface, the body comprising a working surface with a region at least 0.100 to 0.500 inches away from the interface;

providing a cemented metal carbide substrate with a cobalt concentration of 2 to 10 percent by volume; and sintering the body to the substrate in a high pressure, high temperature process just long enough for the cobalt to reach the region such that the cobalt concentration becomes 5 to 0.1 percent of the volume of the region;

wherein at least 99 percent of interstitial voids between particles comprise a catalyzing material.

* * * * *